US009428881B1

(12) United States Patent
Chabura et al.

(10) Patent No.: US 9,428,881 B1
(45) Date of Patent: Aug. 30, 2016

(54) BUCKET WITH MULTI-COMPONENT WRAPPER

(71) Applicant: Caterpillar Inc., Peoria, IL (US)

(72) Inventors: Joseph Chabura, Aurora, IL (US); Mark J. Roeder, Geneva, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 14/658,855

(22) Filed: Mar. 16, 2015

(51) Int. Cl.
*E02F 3/40* (2006.01)

(52) U.S. Cl.
CPC ..... *E02F 3/40* (2013.01)

(58) Field of Classification Search
CPC ..... E02F 3/40; E02F 3/401; E02F 3/404–3/407; E02F 3/3604; E02F 9/00; E02F 9/2825; E02F 9/2883; E02F 9/2816; E02F 7/06
USPC ..... 37/379, 444, 446, 465; 414/722–724
See application file for complete search history.

(56) References Cited

U.S. PATENT DOCUMENTS 4,523,397 A * 6/1985 Lucas ..... E02F 3/401 37/444
5,974,706 A 11/1999 Kaczmarski et al.
6,581,308 B1 6/2003 Woerman et al.
8,015,734 B1 9/2011 Mills et al.
8,069,593 B2 * 12/2011 McClallen et al. ..... E02F 3/40 37/444
8,201,350 B2 * 6/2012 Folkerts et al. ..... E02F 9/2825 37/379
2002/0136597 A1 9/2002 Nishikawa et al.
2012/0301258 A1 11/2012 Nagata et al.
2013/0323000 A1 12/2013 Rochel et al.
2014/0230293 A1 8/2014 Lunn et al.

FOREIGN PATENT DOCUMENTS

CN 201722720 U 1/2011

* cited by examiner

*Primary Examiner* — Robert Pezzuto
(74) *Attorney, Agent, or Firm* — Leydig, Voit & Mayer, Ltd.

(57) ABSTRACT

A bucket for a machine includes a pair of spaced apart side sections that define a width of the bucket and a hinge plate assembly positioned between the pair of side sections. The hinge plate assembly includes a pair of spaced apart hinge plates, with each of the hinge plates including a front boss and a rear boss, a base plate having a first thickness, and an upper wrapper plate having a second thickness that is less than the first thickness. A wrapper has a third thickness that is less than the second thickness and a lip plate includes a lower cutting edge. A receptacle is defined by the pair of side sections, the base plate, the upper wrapper plate, the wrapper, and the lip plate.

20 Claims, 4 Drawing Sheets

BUCKET WITH MULTI-COMPONENT WRAPPER

TECHNICAL FIELD

This disclosure relates generally to a bucket for a machine, and more particularly, to a bucket assembly including a multi-component wrapper.

BACKGROUND

Machines, such as excavators, are used in a wide variety of applications including construction, mining, road building, and trenching. In each application, an excavator uses a bucket to penetrate into material in a pile or a work surface such as the ground to scoop the material, and subsequently dump it in a desired location. The bucket is a key component in efficiently performing a desired operation.

While performing a material moving or digging operation, the buckets are subjected to extreme loads and wear. In addition to withstanding significant loads, a bucket must also be constructed to endure a desired number of cycles or hours of operation. If a bucket fails, in addition to the cost to repair or replace the bucket, the failure may result in lost productivity. Increasing the thickness of the various components of the bucket may increase the life of the bucket but may also adversely impact the capacity of the bucket due to an increase in the weight of the bucket.

U.S. Pat. No. 8,069,593 discloses a bucket for an excavator in which a hinge plate assembly includes a pair of hinge plates with a somewhat V-shaped top plate and a linear bottom plate that are interconnected to form a torque tube. A rib may extend between the hinge plates along the bottom plate to add stiffness to the torque tube. In addition, a rib may extend between one of the hinge plates and an adjacent side bar to further add stiffness to the torque tube.

The foregoing background discussion is intended solely to aid the reader. It is not intended to limit the innovations described herein, nor to limit or expand the prior art discussed. Thus, the foregoing discussion should not be taken to indicate that any particular element of a prior system is unsuitable for use with the innovations described herein, nor is it intended to indicate that any element is essential in implementing the innovations described herein. The implementations and application of the innovations described herein are defined by the appended claims.

SUMMARY

In one aspect, a bucket for a machine includes a pair of spaced apart side sections that define a width of the bucket and a hinge plate assembly positioned between the pair of side sections. The hinge plate assembly includes a pair of spaced apart hinge plates, with each of the hinge plates including a front boss and a rear boss, a base plate having a first thickness, and an upper wrapper plate having a second thickness that is less than the first thickness. A wrapper has a third thickness that is less than the second thickness and a lip plate includes a lower cutting edge. A receptacle is defined by the pair of side sections, the base plate, the upper wrapper plate, the wrapper, and the lip plate.

In another aspect a bucket for a machine includes a first side section having a first side upper portion and a second side section having a second side upper portion with the first side section and the second side section being spaced apart to define a width of the bucket. A torque tube is positioned between the first side upper portion and the second side upper portion and has a pair of spaced apart hinge plates and a lower surface. The lower surface includes a first section and a second section with the first section having a first thickness and the second section having a second thickness that is less than the first thickness. A wrapper extends between the first side section and the second side section and has a third thickness that is less than the second thickness. A lip plate includes a lower cutting edge and a receptacle is defined by the first side section, the second side section, the lower surface of the torque tube, the wrapper, and the lip plate.

In still another aspect, a bucket for a machine includes a pair of side sections that are spaced apart to define a width of the bucket and a hinge plate assembly positioned between the pair of side sections. The hinge plate assembly includes a pair of spaced apart hinge plates, with each hinge plate including a front boss and a rear boss and a center base plate portion having a first thickness extending from one of the hinge plates to the other and including a first leg and a second leg. An outer base plate portion having a fourth thickness extends from one of the hinge plates to one of the side sections and includes a first leg and a second leg. An upper wrapper plate has a second thickness that is less than the first thickness and the fourth thickness and extends between the pair of side sections and along the pair of spaced apart hinge plates. A wrapper has a third thickness that is less than the second thickness, a lip plate includes a lower cutting edge, and a receptacle is defined by the pair of side sections, the center base plate portion, the outer base plate portions, the upper wrapper plate, the wrapper, and the lip plate.

DETAILED DESCRIPTION

Figure 1:
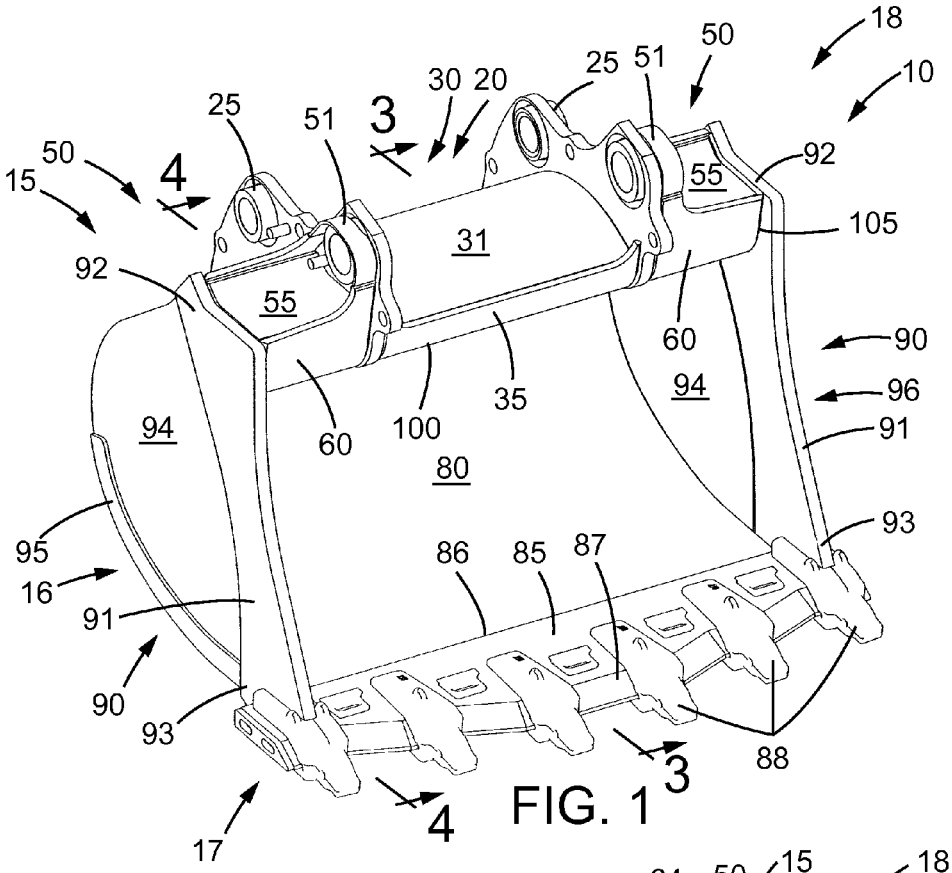
FIG. 1 is a perspective view of a bucket according to the disclosure.
Figure 2:
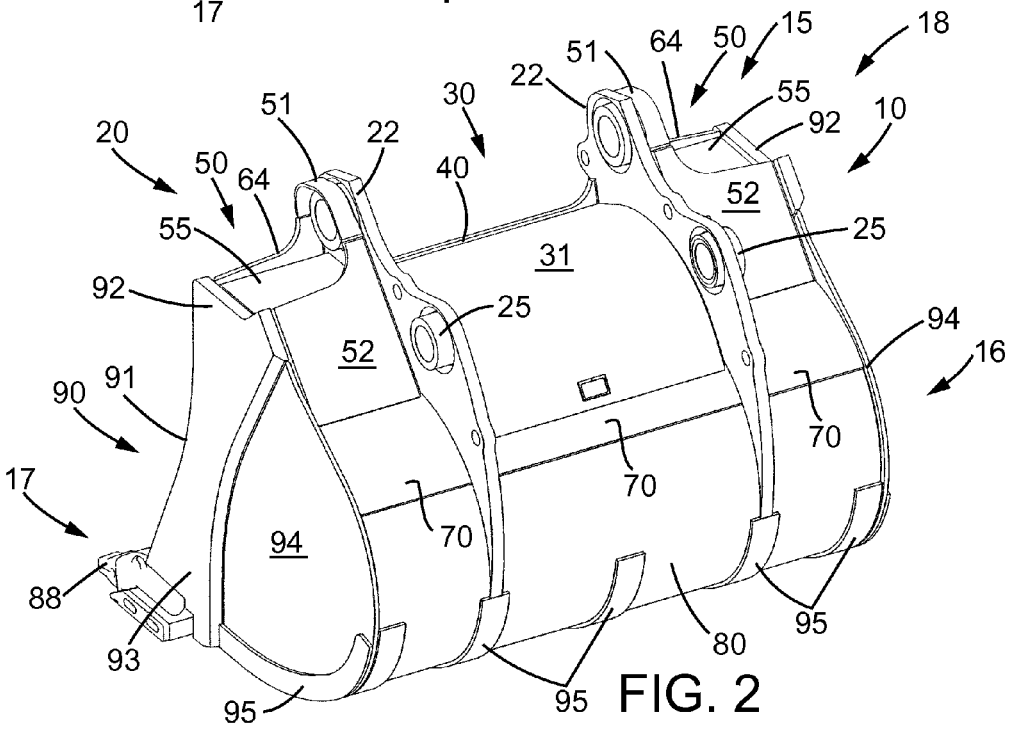
FIG. 2 is a perspective view of the bucket of FIG. 1 but from a different orientation.

FIGS. 1-4 depict a bucket 10 for use with a machine (not shown), such as an excavator, to perform material moving operations such as digging, scooping, lifting, transporting, lowering, and dumping. The machine may include a linkage assembly (not shown) coupled to the bucket 10 for manipulating the bucket as desired.

Bucket 10 includes an upper section 15, a middle or central section 16, and a forward section 17. A pair of side sections 90 extend along the sides of the upper section 15, the central section 16, and the lower section 17, and the distance between the side sections defines the width of the bucket 10. The upper section 15 is operatively connected to the linkage assembly, the central section 16 holds material being moved by the bucket 10, and the forward section 17 is used to dig or engage material or a work surface.

It should be noted that the terms upper and lower as well as any other similar terms are used in reference to the position of the bucket 10 as depicted in the drawings and the bucket may be positioned and used in other orientations. Further, the terms front, forward, and other similar terms refer to the open end of the bucket 10 while the terms rear, rearward, and other similar terms refer to the opposite or closed end of the bucket. In addition, the term laterally and other similar terms refers to the direction parallel to the width of the bucket 10 (i.e., the direction extending between the side sections 90).

A hinge plate assembly 20 extends along the upper section 15 and a portion of the central section 16. Hinge plate assembly 20 has pair of pair of hinge plates 22 that extend generally parallel to the side sections 90. Each hinge plate 22 has a front boss 23 with a first bore 24 and a rear boss 25 with a second bore 26 spaced from the front boss. The first bores 24 of the pair of hinge plates 22 are axially aligned and are configured to receive and support a stick pin (not shown) that passes through the stick (shown in phantom at 11 in FIG. 3) of the linkage assembly of the machine. The second bores 26 of the pair of hinge plates 22 are axially aligned and are configured to receive and support a tool actuator pin (not shown) that passes through the tool actuator of the machine. The hinge plates 22 may include one or more openings or recesses 27 to reduce the weight of the hinge plate. In addition, the hinge plates 22 may be relatively elongated and include a tapered section 28 that extends to provide additional support to the central section 16 of the bucket 10.

Figure 5:
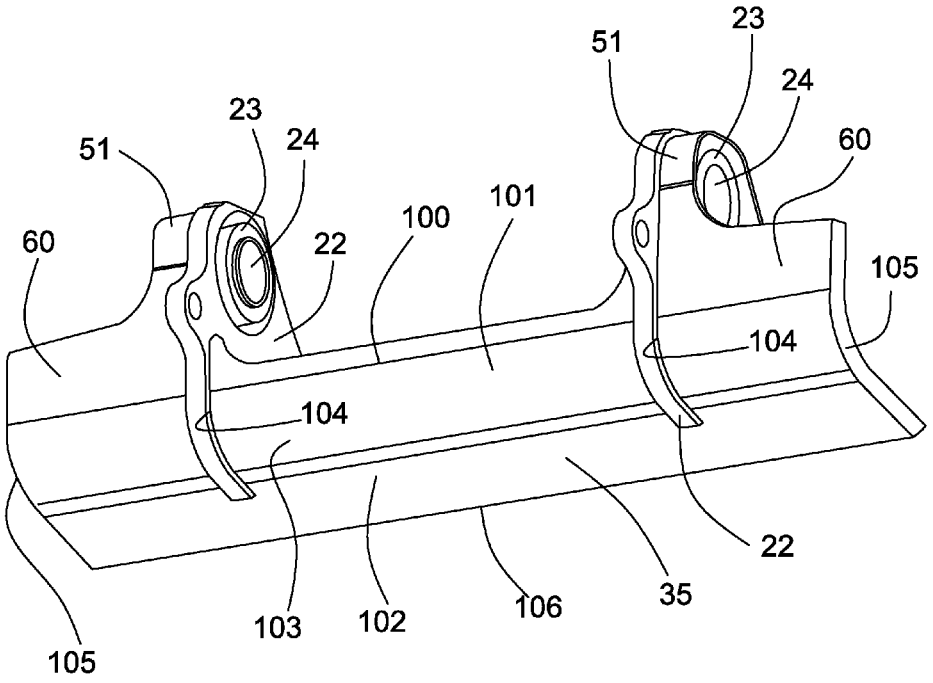
FIG. 5 is a fragmented perspective view of a base plate and a pair of hinge plates.

A base plate 100 extends between the side sections 90 and forms a lower forward portion of the hinge plate assembly. Referring to FIG. 5, the base plate 100 includes a linear first leg 101 and a linear second leg 102 interconnected by a curved section 103 to create an angle between the two legs. As depicted, the first leg 101 and the second leg 102 define an obtuse angle of approximately 120 degrees. The linear legs may define other angles if desired.

Base plate 100 may include a pair of spaced apart slots 104 that each extend through the first leg 101, the curved section 103, and a portion of the second leg 102. The pair of spaced apart slots 104 define a center base plate portion 35 of the base plate 100 between the slots and a pair of outer base plate portions 60 that extend from the slots to respective outer edges 105 of the base plate.

Hinge plate assembly 20 includes a central section 30, extending from one hinge plate 22 to the other, and a pair of outer sections 50, with each outer section extending laterally from one of the hinge plates to its respective side section 90.

Figure 3:
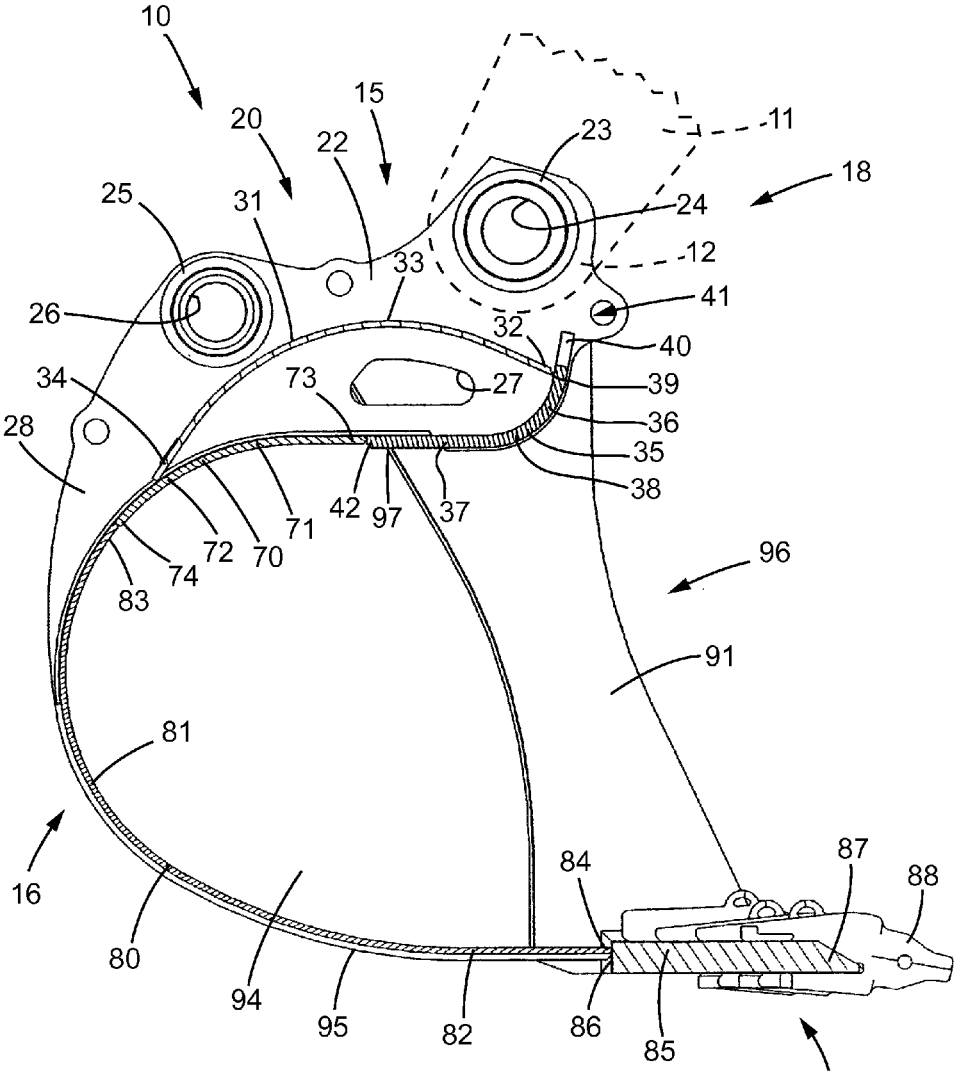
FIG. 3 is a section taken generally along line 3-3 in FIG. 1.

Referring to FIG. 3, the central section 30 includes a curved or arcuate upper center plate 31 and the center base plate portion 35 of base plate 100. The upper center plate 31 extends laterally relative to the bucket from one hinge plate 22 to the other and beneath both the front boss 23 and the rear boss 25. As best seen in FIG. 5, a portion of the center base plate portion 35 extends laterally relative to the bucket 10 between the two hinge plates 22 while a second portion extends along and below the hinge plates.

Referring back to FIG. 3, the center base plate portion 35 has a linear first leg 36 and a linear second leg 37 interconnected by a curved section 38. The first leg 36 is a portion of first leg 101 of base plate 100, second leg 37 is a portion of second leg 102, and curved section 38 is a portion of curved section 103. The first leg 36 intersects with the front end 32 of the upper center plate 31 at intersection 39. The cantilevered free end 40 of the first leg 36 may extend past the front end 32 of the upper center plate 31.

The rearward end 42 of the second leg 37 is generally aligned vertically at approximately the midpoint 33 of the upper center plate 31. In other words, the second leg 37 only extends rearwardly partway towards the rear end 34 of the upper center plate 31 and a vertical line through the rearward end 42 intersects the upper center plate 31 at approximately its midpoint 33. Still further, it may be seen that the rearward end 42 is generally aligned with a rearward edge 97 of side bar 91.

Figure 4:
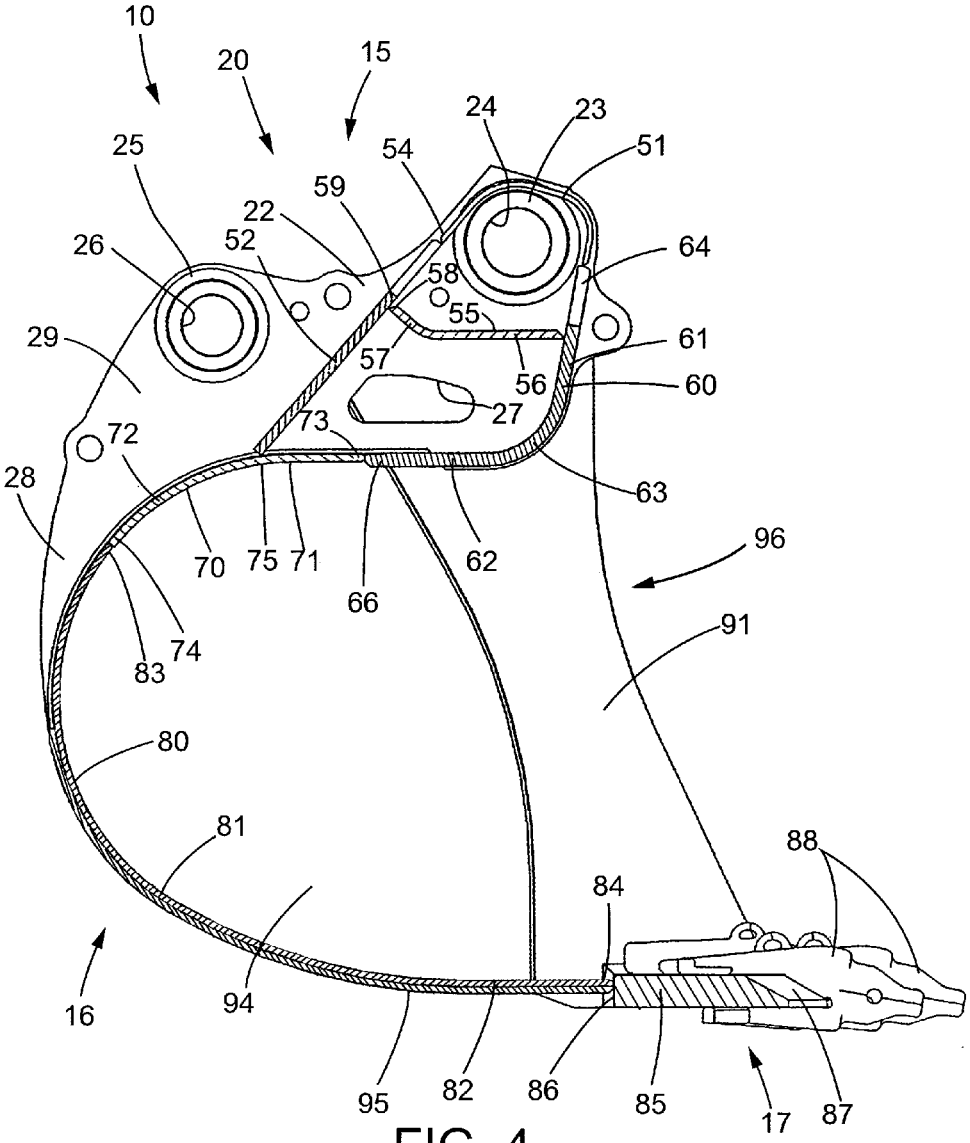
FIG. 4 is a section taken generally along line 4-4 in FIG. 1.

Referring to FIG. 4, each outer section 50 includes an arcuate front boss plate 51 that extends around approximately the upper half of the front boss 23. A linear rear side outer plate 52 extends from a generally central location 75 of the upper wrapper plate 70 to a rearward edge 54 of the front boss plate 51. An under boss outer plate 55 has a linear first section 56 and a linear second section 57 that extends at an obtuse angle relative to the first section. A rearward edge 58 of the second section 57 intersects with the rear side outer plate 52 at intersection 59.

Each outer section 50 also includes the outer base plate portion 60 of base plate 100 that extends from one of the hinge plates 22 to side section 90. The outer base plate portion 60 has a generally linear first leg 61 and a generally linear second leg 62 interconnected by a curved section 63. The first leg 61 is a portion of first leg 101 of base plate 100, second leg 62 is a portion of second leg 102, and curved section 63 is a portion of curved section 103. In some embodiments, the first leg 61 of each outer base plate portion 60 may be aligned with the first leg 36 of the center base plate portion 35 so that the first legs 61 are co-planar with the first leg 36 and the second leg 62 may be aligned with the second leg 37 of the center base plate portion 35 so that the second legs 62 are co-planar with the second leg 37.

Comparing FIGS. 3-4, it will be appreciated that the first leg 61 of each outer base plate portion 60 may be longer than the first leg 36 of the center base plate portion 35 and has a free end 64 that extends to a forward edge 65 of the front boss plate 51. The second leg 62 of each outer base plate portion 60 may include a rearward end 66 aligned with the rearward end 42 of the second leg 37 of the center base plate portion 35 (and defining a rearward end 106 of the second leg 102 of base plate 100). Although the base plate 100 is formed as a one-piece continuous joint-free member or component that extends laterally between the side sections 90, the base plate may be configured with the center base plate portion 35 and the outer base plate portions 60 formed as separate components that are interconnected together and/or to the hinge plates 22.

Hinge plate assembly 20 further includes an upper wrapper plate 70 that extends laterally between the side sections 90 and is positioned rearwardly from the rearward end 106 of base plate 100. Upper wrapper plate 70 includes a generally linear first section 71 and a curved or arcuate second section 72. The first section 71 has a forward end 73 adjacent the rearward end 106 of base plate 100. The second section 72 has a rearward end 74 that extends partway along the tapered section 28 of the hinge plates 22. In one embodiment, the upper wrapper plate 70 may be a one-piece continuous joint-free member that extends between the pair of side sections 90. In another embodiment, the upper wrapper plate 70 may be one piece member that is formed of a plurality of components that are joined together, such as by welding.

Central section 16 includes a wrapper 80 that extends laterally between the side sections 90. The wrapper 80 has a curved or arcuate upper section 81 and a generally linear lower section 82. The upper section 81 has an upper end 83 adjacent the rearward end 74 of the upper wrapper plate 70. The lower section 82 has a forward end 84 adjacent the forward section 17 of the bucket 10. In one embodiment, the wrapper 80 may be a one-piece continuous joint-free member that extends between the pair of side sections 90. In another embodiment, the wrapper 80 may be one piece member that is formed of a plurality of components that are joined together, such as by welding.

The forward section 17 of the bucket includes a lip plate 85 having a generally linear rearward end 86 adjacent the forward end 84 of the wrapper 80. The lip plate 85 includes a lower cutting edge 87 that may be laterally curved or arcuate and vertically beveled or tapered. A plurality of adapters 88 may be positioned along the cutting edge 87 and are configured to receive a tooth or tip (not shown) thereon. Cutting edge 87 and the tips are configured to engage and penetrate material or a work surface. The lip plate 85 may be wider laterally than the wrapper 80, if desired.

Bucket 10 also includes a side section 90 along each lateral edge of the upper section 15, the central section 16, and the forward section 17. Each side section 90 includes a side bar 91 that extends vertically between and interconnects the upper section 15 and the forward section 17. More specifically, an upper portion 92 of each side bar 91 is interconnected to a portion of the rear side outer plate 52, the under boss outer plate 55, and the outer base plate portion 60. The lower portion 93 of each side bar 91 is interconnected to the wrapper 80 and the lip plate 85. Each side section 90 also includes a side plate 94 that extends along and is interconnected to upper wrapper plate 70, wrapper 80, and side bar 91. If desired, reinforcement plates 95 may be mounted on outer surfaces of wrapper 80 and side plates 94.

Components of the hinge plate assembly 20 cooperate to form a torque tube 18. Torque tube 18 operates to transfer torque from the hinge plates 22 and distribute the torque, and thus associated stresses, throughout the bucket 10. The torque tube 18 is formed of a series of elongated components that are interconnected to form a series of somewhat tube-shaped structures with a generally continuous cross-section that extend between the side sections 90. Referring to FIG. 3, an enclosed or continuous cross-section or perimeter of the center portion of the torque tube 18 is defined by the upper center plate 31, the center base plate portion 35 (other than free end 40), and the upper wrapper plate 70 from its forward end 73 to the intersection of the rear end 34 of the upper center plate 31 with the upper wrapper plate.

Referring to FIG. 4, an enclosed or continuous cross-section or perimeter of the outer portions of the torque tube 18 is defined by the portion of the rear side outer plate 52 extending from the intersection of the rear side outer plate with the upper wrapper plate 70 to the intersection 59 of the rear side outer plate with the under boss outer plate 55, the under boss outer plate 55, the outer base plate portion 60 (other than free end 64), and the upper wrapper plate 70 from its forward end 73 to the intersection of the rear side outer plate 52 with the upper wrapper plate.

The hinge plates 22 operate or function to connect the outer portions of the torque tube 18 with the center portion of the torque tube. In addition, the upper portions 92 of the side bars 91 operate or function to close the ends of the outer portions of the torque tube 18 to provide additional strength and rigidity.

Based upon the foregoing, it may be appreciated that the torque tube 18 may have a generally linear lower surface that includes a first section and a second section. The first section is defined by the second leg 102 of the base plate 100 and the second section is defined by the first section 71 of upper wrapper plate 70.

Receptacle 96 of bucket 10 is configured to receive material therein. Receptacle 96 is defined by a portion of base plate 100 (i.e., second leg 102), upper wrapper plate 70, wrapper 80, lip plate 85, side bars 91, and side plates 94.

Each of the components of the bucket 10 may be formed of steel or another desired material. To assemble the bucket 10, each of the components may be welded or otherwise connected together as is known in the art.

The components of bucket 10 are configured and dimensioned to improve the performance of the bucket and to improve its manufacturability. For example, base plate 100 (or center base plate portion 35 and the outer base plate portion 60, if formed from separate components) may have a first thickness and the upper wrapper plate 70 may have a second thickness, with the second thickness being less than the first thickness. In addition, the wrapper 80 may have a third thickness that is less than the second thickness. In one example, the thickness of the base plate 100 may be approximately 40 mm, the thickness of the upper wrapper plate 70 may be approximately 25 mm, and the thickness of the wrapper 80 may be approximately 20 mm.

Other dimensions are contemplated. In one example, the thickness of the base plate 100 may range from approximately 35 mm to 50 mm, the thickness of the upper wrapper plate 70 may range from approximately 22 mm to 45 mm, and the thickness of the wrapper 80 may range from approximately 17 mm to 30 mm. In another example, the differences in thickness may be expressed in terms of percentages of the different components. For example, the wrapper 80 may have a thickness such as approximately 20 mm, the upper wrapper plate 70 may have a thickness at least approximately 110 percent of the thickness of the wrapper, and the base plate 100 may have thicknesses at least approximately 150 percent of the thickness of the wrapper.

In some embodiments, it may be desirable to increase thicknesses in a proportional manner. For example, an increase of twenty five percent over the first example specified above would result in the base plate 100 having a thickness of approximately, 50 mm, the upper wrapper plate 70 having a thickness of approximately 31.25 mm, and the wrapper 80 having a thickness of approximately 25 mm. In other embodiments, it may be possible to increase the thickness of one or more components while maintaining the original thickness, only slightly increasing the original thickness, or even reducing the original thickness of another component, and using the increases in the thickness of the one or more components to compensate for a reduction in thickness of the another component as compared to a proportional increase.

It should be noted that if the center base plate portion 35 and the outer base plate portion 60 are separate components, they may have different thicknesses, if desired. Accordingly, when referring to the thickness of the base plate herein, if the base plate is formed of a plurality of components, the reference to the thickness is to at least one but not all of the components of the base plate, unless otherwise stated.

INDUSTRIAL APPLICABILITY

The industrial applicability of the embodiments of the bucket 10 described herein will be readily appreciated from the foregoing discussion. The bucket 10 may be used with any desired machine including an excavator and in any desired industry.

Bucket 10 is configured to reduce stress concentrations in the bucket and thus increase its life. In addition, the bucket construction may also permit a reduction in weight of the bucket and thus increase its load carrying capacity. Still further, the bucket construction also simplifies the manufacturing process, which is especially desirable when manufacturing large buckets.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. A bucket for a machine comprising:

a pair of side sections, the pair of side sections being spaced apart to define a width of the bucket;

a hinge plate assembly positioned between the pair of side sections, the hinge plate assembly including:

a pair of spaced apart hinge plates, each hinge plate including a front boss and a rear boss, a base plate having a first thickness, and an upper wrapper plate having a second thickness, the second thickness being less than the first thickness;

a wrapper having a third thickness, the third thickness being less than the second thickness; and a lip plate including a lower cutting edge; and a receptacle defined by the pair of side sections, the base plate, the upper wrapper plate, the wrapper, and the lip plate.

2. The bucket of claim 1, wherein the base plate includes a center base plate portion and a pair of outer base plate portions, the center base plate portion extending from one of the pair of spaced apart hinge plates to another of the pair of spaced apart hinge plates, and an outer base plate portion extending from one of the pair of spaced apart hinge plates to one of the pair of side sections.

3. The bucket of claim 2, wherein the center base plate portion and each of the pair of outer base plate portions include a first leg and a second leg, the first legs of each of the center base plate portion and the pair of outer base plate portions being co-planar, and the second legs of each of the center base plate portion and the pair of outer base plate portions being co-planar.

4. The bucket of claim 3, wherein the first leg of the center base plate portion and the second leg of the center base plate portion form an obtuse angle.

5. The bucket of claim 1, wherein the hinge plate assembly includes a center section between the pair of spaced apart hinge plates, and a pair of outer sections, each of the pair of outer sections being between one of the pair of spaced apart hinge plates and one of the pair of side sections.

6. The bucket of claim 5, wherein the center section includes a continuous cross-section defined by a center base plate portion, the upper wrapper plate, and an upper center plate, and each of the pair of outer sections includes a continuous cross-section defined by an outer base plate portion, the upper wrapper plate, a rear side outer plate, and an under boss outer plate.

7. The bucket of claim 6, wherein the rear side outer plate is generally planar and a plane of the rear side outer plate extends between the front boss and the rear boss, and the under boss outer plate extends between the rear side outer plate and the outer base plate portion and extends between the front boss and the upper wrapper plate.

8. The bucket of claim 6, wherein the upper center plate is arcuate and extends from the center base plate portion to an arcuate section of the upper wrapper plate.

9. The bucket of claim 1, wherein the first thickness is between 35 mm and 50 mm, the second thickness is between 22 mm and 45 mm, and the third thickness is between 17 mm and 30 mm.

10. The bucket of claim 1, wherein the first thickness is at least approximately 150 percent of the third thickness, and the second thickness is at least approximately 110 percent of the third thickness.

11. The bucket of claim 1, wherein the first thickness is approximately 40 mm, the second thickness is approximately 25 mm, and the third thickness is approximately 20 mm.

12. The bucket of claim 1, wherein the base plate has a first leg and a second leg, the first leg being at an angle to the second leg, the second leg being generally linear, and the upper wrapper plate having a first section and a second section, the first section being generally linear and the second section being arcuate, the second leg of the base plate and the first section of the upper wrapper plate being generally co-planar.

13. The bucket of claim 1, wherein the wrapper has a first section and a second section, the first section being arcuate and the second section being generally linear, the second section intersecting with the lip plate.

14. The bucket of claim 1, wherein the upper wrapper plate is a continuous joint-free member and extends between the pair of side sections.

15. The bucket of claim 1, wherein the wrapper is a continuous joint-free member and extends between the pair of side sections.

16. A bucket for a machine comprising:

a first side section having a first side upper portion, a second side section having a second side upper portion, the first side section and the second side section being spaced apart to define a width of the bucket;

a torque tube positioned between the first side upper portion and the second side upper portion, the torque tube having a pair of spaced apart hinge plates, each hinge plate including a front boss and a rear boss, the torque tube having a lower surface, the lower surface including a first section and a second section, the first section having a first thickness and the second section having a second thickness, the second thickness being less than the first thickness;

a wrapper extending between the first side section and the second side section and having a third thickness, the third thickness being less than the second thickness;

a lip plate including a lower cutting edge; and a receptacle defined by the first side section, the second side section, the lower surface of the torque tube, the wrapper, and the lip plate.

17. The bucket of claim 16, further including an upper wrapper plate, the upper wrapper plate including a first section and a second section, the first section being generally linear and the second section being arcuate, the first section of the upper wrapper plate being the second section of the lower surface of the torque tube, and the torque tube having a base plate, the base plate including a first leg and a second leg, the second leg being generally planar and being the first section of the lower surface of the torque tube.

18. The bucket of claim 17, wherein the torque tube includes a center section between the pair of spaced apart hinge plates, and a pair of outer sections, each of the pair of outer sections being between one of the pair of spaced apart hinge plates and one of the first side section and the second side section, and the upper wrapper plate extends between the first side section and the second side section and along the pair of spaced apart hinge plates.

19. A bucket for a machine comprising:

a pair of side sections, the pair of side sections being spaced apart to define a width of the bucket;

a hinge plate assembly positioned between the pair of side sections, the hinge plate assembly including:

a pair of spaced apart hinge plates, each hinge plate including a front boss and a rear boss, a center base plate portion extending from one of the pair of spaced apart hinge plates to another of the pair of spaced apart hinge plates, the center base plate portion including a first leg and a second leg and having a first thickness;

a pair of outer base plate portions, each outer base plate portion extending from one of the pair of spaced apart hinge plates to one of the pair of side sections, each outer base plate portion including a first leg and a second leg and having a fourth thickness; and an upper wrapper plate having a second thickness, the second thickness being less than the first thickness and the fourth thickness, the upper wrapper plate extending between the pair of side sections and along the pair of spaced apart hinge plates;

a wrapper having a third thickness, the third thickness being less than the second thickness;

a lip plate including a lower cutting edge; and a receptacle defined by the pair of side sections, the center base plate portion, the pair of outer base plate portions, the upper wrapper plate, the wrapper, and the lip plate.

20. The bucket of claim 19, wherein the first thickness and the fourth thickness are approximately equal.

* * * * *